US008931576B2

(12) United States Patent
Iwata

(10) Patent No.: US 8,931,576 B2
(45) Date of Patent: Jan. 13, 2015

(54) POWER TOOL FOR PERFORMING SOFT-START CONTROL APPROPRIATED FOR MOTOR LOAD

(75) Inventor: Kazutaka Iwata, Hitachinaka (JP)

(73) Assignee: Hitachi Koki., Ltd., Tokyo (JP)

( * ) Notice: Subject to any disclaimer, the term of this patent is extended or adjusted under 35 U.S.C. 154(b) by 685 days.

(21) Appl. No.: 13/109,860

(22) Filed: May 17, 2011

(65) Prior Publication Data

US 2011/0284256 A1 Nov. 24, 2011

(30) Foreign Application Priority Data

May 19, 2010 (JP) ..... 2010-115152

(51) Int. Cl.
*B25F 5/00* (2006.01)

(52) U.S. Cl.
CPC ..... *B25F 5/00* (2013.01)
USPC ..... 173/179; 173/176; 173/180; 173/181

(58) Field of Classification Search
USPC ..... 173/176–181; 318/432–434
See application file for complete search history.

(56) References Cited

U.S. PATENT DOCUMENTS

| | | | | |
|---|---|---|---|---|
| 5,014,793 | A * | 5/1991 | Germanton et al. | 173/181 |
| 5,440,215 | A * | 8/1995 | Gilmore | 318/432 |
| 6,873,124 | B2 | 3/2005 | Kawano et al. | |
| 8,179,069 | B2 | 5/2012 | Matsunaga et al. | |
| 2003/0047331 | A1 * | 3/2003 | Henderson et al. | 173/4 |
| 2009/0206783 | A1 | 8/2009 | Zhao et al. | |

FOREIGN PATENT DOCUMENTS

| | | | |
|---|---|---|---|
| CN | 201001026 | Y | 1/2008 |
| CN | 101217252 | A | 7/2008 |
| CN | 101372095 | A | 2/2009 |
| CN | 101377229 | A | 3/2009 |
| CN | 201222872 | Y | 4/2009 |
| CN | 101572522 | A | 11/2009 |
| DE | 2811302 | A1 | 9/1979 |
| JP | 2004-194422 | A | 7/2004 |
| JP | 2003-159669 | A | 6/2009 |

OTHER PUBLICATIONS

Office Action from China Intellectual Property Office for application 201110135415.6 (Aug. 8, 2013).

* cited by examiner

*Primary Examiner* — Michelle Lopez
(74) *Attorney, Agent, or Firm* — Kilpatrick Townsend & Stockholm LLP

(57) ABSTRACT

A power tool has a motor, a power supply unit, a trigger unit, a control unit, and a motor load detection unit. The power supply unit supplies power to the motor. The trigger unit causes the power supply unit to start applying a voltage to the motor. The control unit controls the power supply unit to increase the voltage to the motor at a constant increasing rate. The motor load detection unit detects a motor load. The control unit changes the constant increasing rate in accordance with the motor load.

14 Claims, 8 Drawing Sheets

POWER TOOL FOR PERFORMING SOFT-START CONTROL APPROPRIATED FOR MOTOR LOAD

CROSS REFERENCE TO RELATED APPLICATIONS

This application claims priority from Japanese Patent Application No. 2010-115152 filed May 19, 2010. The entire content of each of these priority applications is incorporated herein by reference.

TECHNICAL FIELD

The present invention relates to a power tool, and particularly to a power tool that performs soft-start control.

BACKGROUND

When the motor is started in a motor-driven device, a starting current flow proportional to the effective value of the applied voltage passes through the motor. However, a significantly large starting current passing through the motor will cause a rise in temperature that may lead to burnout in the motor or other circuit components. Accordingly, some power tools known in the art perform soft-start control for gradually increasing the voltage applied to the motor at startup.

Since the amount of the starting current is dependent on the effective voltage applied to the motor with respect to the rotational speed of the motor, as described above, in the motor, a small amount of starting current passes when the load is light and a large starting current when the load is heavy. Hence, it is unlikely that the device will generate a large starting current for a light load, such as the load produced when driving a small screw.

However, since a conventional power tool gradually increases the voltage applied to the motor at a fixed rate, even when the load is light, the time period required to complete the starting phase of the motor is longer than necessary, worsening the power tool's ability to supply power to the motor in response to trigger operations. The performance of the power tool will feel particularly poor to the user when tightening a small screw through repeated on/off trigger operations. On the other hand, when the load is larger than expected, the conventional power tool may try to pass a considerably large amount of starting current to drive the motor, even during soft-start control, producing a rise in temperature that may cause burnout in the motor or circuit components.

SUMMARY

In view of the foregoing, it is an object of the present invention to provide a power tool capable of performing soft-start control appropriate for a motor load.

The present invention provides a power tool having a motor, a power supply unit, a trigger unit, a control unit, and a motor load detection unit. The power supply unit supplies power to the motor. The trigger unit causes the power supply unit to start applying a voltage to the motor. The control unit controls the power supply unit to increase the voltage to the motor at a constant increasing rate. The motor load detection unit detects a motor load. The control unit changes the constant increasing rate in accordance with the motor load.

Preferably, the control unit includes a determination unit that determines whether the motor load is heavy or light. The control unit increases the constant increasing rate if the determination unit determines that the motor load is light.

Preferably, the power tool further includes a detection unit and a determination unit. The detection unit detects a rotational speed of the motor. The determination unit determines whether the rotational speed of the motor exceeds a threshold within a first time period after a beginning of power supply to the motor. The control unit increases the constant increasing rate if the determination unit determines that the rotational speed of the motor exceeds the threshold.

Preferably, the control unit has a plurality of thresholds. The control unit increases the constant increasing rate every time the detected rotational speed exceeds the plurality of thresholds in ascending order.

Preferably, the power supply unit includes a switching unit that is controlled by Pulse Width Modulation (PWM) to supply power to the motor.

Preferably, the voltage application unit includes a switching unit that is controlled by Thyristor Phase control to supply power to the motor.

Preferably, the voltage applied to the motor is an effective value.

Preferably, the threshold is used to determine whether the motor load is heavy or light. If the rotational speed exceeds the threshold within the first time period, the control unit determines that the motor load is light. If the rotational speed does not exceed the threshold within the first time period, the control unit determines that that the motor load is heavy.

Preferably, the motor load detection unit detects a rotational speed of the motor within a first time period from a beginning of power supply to the motor. The control unit determines whether the motor load is heavy or light in accordance with the detected motor load. If the detected rotational speed exceeds a threshold within the first time period, the control unit determines that the motor load is light and then increases the constant increasing rate. If the detected rotational speed does not exceed the threshold, the control unit determines that the motor load is heavy and then maintain the constant increasing rate.

With this construction, the power tool can vary the rate of increase in voltage applied to the motor based on the magnitude of load, thereby performing soft-start control appropriate for the magnitude of load.

The power tool having this construction increases the rate of voltage when the magnitude of load is no greater than a prescribed threshold, i.e., when the load is light, thereby shortening the time required to increase the power supplied to the motor to the target value. Providing the power tool with the ability to accelerate the motor from a rest state to a high rotational speed in a short amount of time can greatly improve the capability of the power tool to supply power to the motor in response to trigger operations.

It should be noted that a voltage generally means an effective voltage unless the especial explanation is exceptional. Further it is noted that whether a motor load is heavy or light is determined in accordance with a rotational speed of the motor within a predetermined time period starting from the beginning of rotation of the motor.

With the above construction, the power tool can easily determine the size of a motor load by detecting the rotational speed of the motor and the current flowing therethrough.

With the above construction, the power tool can perform soft-start control that is appropriate for the size of load.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
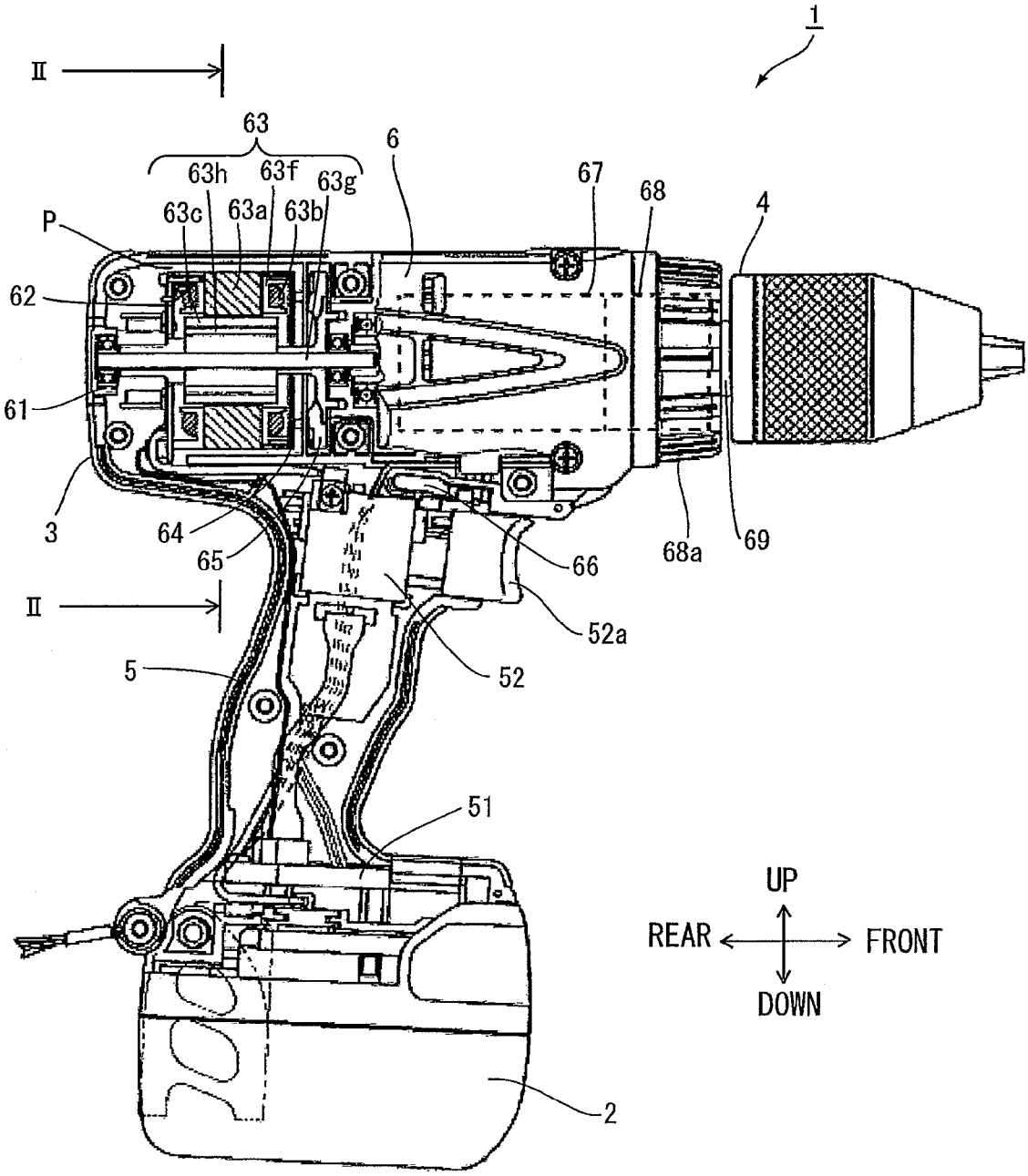
FIG. 1 is a partial cross-sectional view of a drill driver as a power tool according to the present invention.

An embodiment of the present invention will be described while referring to FIGS. 1 through 8, wherein parts and components having similar functions are designated with the same reference numerals to avoid duplicating description. The expressions "front", "rear", "above" and "below" are used throughout the description to define the various parts when the printer is disposed in an orientation in which it is intended to be used. Further, a voltage in the present invention generally means an effective voltage unless the explanation is exceptional.

Referring to FIG. 1, a drill driver 1 includes a battery pack 2, a housing 3, and a chuck 4.

The battery pack 2 is provided with a plurality of secondary batteries and is capable of supplying power to the housing 3 when connected to the same. In this embodiment, the battery pack 2 is provided with four lithium-ion battery-cells connected in series. Each of the lithium-ion batteries has a rated output voltage of 3.6 V. While a nickel-cadmium battery or a nickel-metal hydride battery may also be used as the secondary battery-cell, a lithium-ion battery is preferable because the lithium-ion battery is small and light and possess an energy density approximately three times that of a nickel-cadmium or a nickel-metal hydride battery-cell. Alternatively, a commercial power source may be used to supply power to the housing 3 in place of the battery pack 2.

The housing 3 is configured of a handle section 5 and a body section 6 that are integrally molded of a synthetic resin material.

The battery pack 2 is detachably mounted on the bottom end of the handle section 5. The handle section 5 also houses a control circuit section 51, and a trigger unit 52.

An intake 61 is formed in the rear end portion of the body section 6. In order from the rear side toward the front side, the body section 6 houses an inverter circuit section 62, a motor 63, a dustproof cover 64, a cooling fan 65, a forward/reverse switching lever 66, a reduction gear mechanism 67, a clutch mechanism 68, and a spindle 69.

The control circuit section 51 is disposed in the handle section 5 at the bottom end thereof and expands in front-and-rear and left-and-right directions. The control circuit section 51 functions to control the inverter circuit section 62.

The trigger unit 52 is provided with a trigger operating part 52*a*. The trigger operating part 52*a* protrudes from the handle section 5 near the upper end thereof and is urged forward by a spring (not shown). The trigger unit 52 outputs a signal to the control circuit section 51 specifying the target value for power output corresponding to the degree in which the trigger operating part 52*a* is pressed inward. Based on this target value signal, the control circuit section 51 generates a pulse width modulation (PWM) drive signal for driving the inverter circuit section 62. The process by which the control circuit section 51 generates the PWM drive signal will be described later.

The inverter circuit section 62 includes a disc-shaped circuit board on which are mounted switching elements Q1-Q6 (see FIG. 3) configured of insulated-gate bipolar transistors (IGBT). The gates of the switching elements Q1-Q6 are connected to the control circuit section 51 (a control signal output circuit 518 described later), while the collectors and emitters of the switching elements Q1-Q6 are connected to the motor 63 (stator coils 63*b*). By turning the switching elements Q1-Q6 on and off based on the PWM drive signal outputted from the control circuit section 51, the inverter circuit section 62 converts the DC voltage supplied from the battery pack 2 to AC voltage and outputs this AC voltage to the motor 63. While IGBTs are used as the switching elements Q1-Q6 in this embodiment, the switching elements may be configured of field-effect transistors (MOSFETs) or the like.

Figure 2:
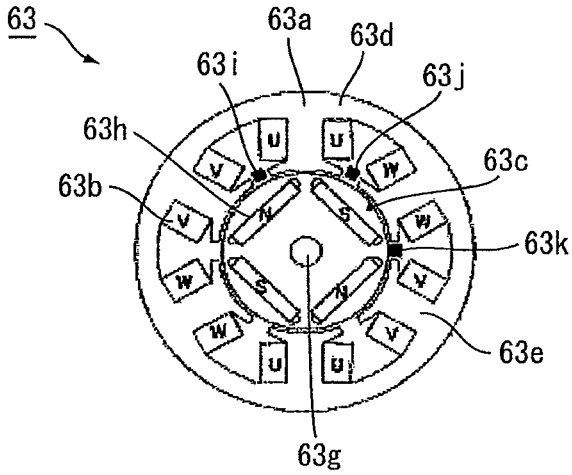
FIG. 2 is a cross-sectional view of a motor taken along the line II-II in FIG. 1.

Next, the structure of the motor 63 will be described with reference to FIG. 2. FIG. 2 shows a cross-sectional view of the motor 63 which is a 3-phase brushless DC motor having an internal magnet arrangement. The motor 63 includes a stator 63*a*, three-phase (U-phase, V-phase, and W-phase) stator coils 63*b*, and a rotor 63*c*.

The stator 63*a* has a cylindrical outer shape and is configured of a cylindrical part 63*d*, and six tooth parts 63*e* protruding radially inward from the cylindrical part 63*d*.

The three-phase (U, V, W) stator coils 63*b* are connected in a Y (or "star") formation. The stator coil 63*b* for each of the phases U, V, and W is wound about two opposing tooth parts 63*e* with an insulating layer 63*f* (see FIG. 1) formed of a resin material interposed therebetween. The rotor 63*c* is disposed radially inward of the tooth parts 63*e*. The rotor 63*c* includes an output shaft 63*g*, and permanent magnets 63*h*. The permanent magnets 63*h* extend along the axial direction of the output shaft 63*g* so that the north (N) and south (S) poles of the permanent magnets 63*h* alternate every 90 degrees in the rotational direction.

Three Hall ICs 63*i*-63*k* are arranged near the rotor 63*c* at 60 degree intervals along the rotational direction thereof.

Each of the Hall ICs 63*i*-63*k* detects a magnetic field generated by the permanent magnets 63*h*. The position of the permanent magnets 63*h* is determined in accordance with output signals of the Hall ICs 63*i*-63*k*. As an alternative to providing the Hall ICs 63*i*-63*k*, the drill driver 1 may employ a sensorless method for detecting the rotated position of the rotor 63*c* whereby a filter is used to detect the induced electromagnetic force (back-emf) of the stator coils 63*b* as a logic signal.

As shown in FIG. 1, the rear end of the stator 63*a* is entirely covered by the disc-shaped circuit board of the inverter circuit section 62, while the front end is covered by the dustproof cover 64. Hence, the inverter circuit section 62, stator 63*a*, and dustproof cover 64 together form a dustproof structure (hermetically sealed structure) for closing or sealing off the rotor 63*c* to prevent dust penetration.

The handle section 5 and body section 6 can be separated into left and right halves along a vertical plane crossing the output shaft 63*g* of the motor 63. A plurality of stator retaining parts (not shown) is formed on the body section 6. When assembling the left and right halves of the handle section 5 and body section 6 (hereinafter referred to as "housing members"), the motor 63 and the like are mounted in one of either the left and right halves of the housing members, and the other halves are assembled to the first halves so that the stator 63*a* is retained in the stator retaining members. Subsequently, the two halves of the housing members are secured with screws or the like.

The cooling fan 65 is provided coaxially with the output shaft 63*g* on the front side of the motor 63. An outlet (not shown) is formed in the body section 6 near the cooling fan 65, and the intake 61 is formed in the rear side of the body section 6. The path formed from the intake 61 to the outlet constitutes a flow path P. Air passing through the flow path P suppresses a rise in the temperature of the switching elements Q1-Q6 and the stator coils 63*b*. When the switching elements Q1-Q6 generate a large amount of heat, the cooling fan 65 supplies cooling air into the flow path P for forcibly cooling the switching elements Q1-Q6.

The reduction gear mechanism 67 is configured of a two-stage planetary gear reduction mechanism (not shown) well known in the art, for example. The reduction gear mechanism 67 functions to reduce the torque (rotational speed) outputted from the output shaft 63*g* of the motor 63.

The clutch mechanism 68 functions to engage the spindle 69 with and disengage the spindle 69 from the output shaft of the reduction gear mechanism 67. The clutch mechanism 68 is provided with a dial 68*a* for switching operating modes and adjusting torque. By rotating the dial 68*a* in this embodiment, the operator can select between a driver mode and a drill mode, and, in the driver mode, can further adjust the allowable load applied by the workpiece to the spindle 69 (slip torque) to one of ten different levels.

When a load greater than the selected slip torque is applied to the spindle 69 in the driver mode, the clutch mechanism 68 disengages the spindle 69 from the output shaft of the reduction gear mechanism 67. Through this configuration, the output shaft of the reduction gear mechanism 67 (i.e., the motor 63) rotates idly, which prevents the motor 63 from locking up from the excessive load.

However, when the drill mode is selected, the clutch mechanism 68 does not disengage the spindle 69 from the output shaft of the reduction gear mechanism 67, even when an excessive load is applied to the spindle 69. Hence, when the load becomes excessive in the drill mode, the tip tool held in the spindle 69 locks up, and consequently the motor 63 also locks up. Here, a common impact mechanism may be provided in place of the clutch mechanism 68.

The chuck 4 is mounted on the spindle 69 for removably holding a tip tool (not shown), such as a drill bit or driver bit. When the tip tool is mounted in the chuck 4, the spindle 69 can transfer torque to the tip tool.

The forward/reverse switching lever 66 protrudes outward from the middle portion of the body section 6 and functions to switch the rotating direction of the motor 63 (rotor 63*c*). When operated, the forward/reverse switching lever 66 outputs a rotating direction signal corresponding to the selected rotating direction.

Figure 3:
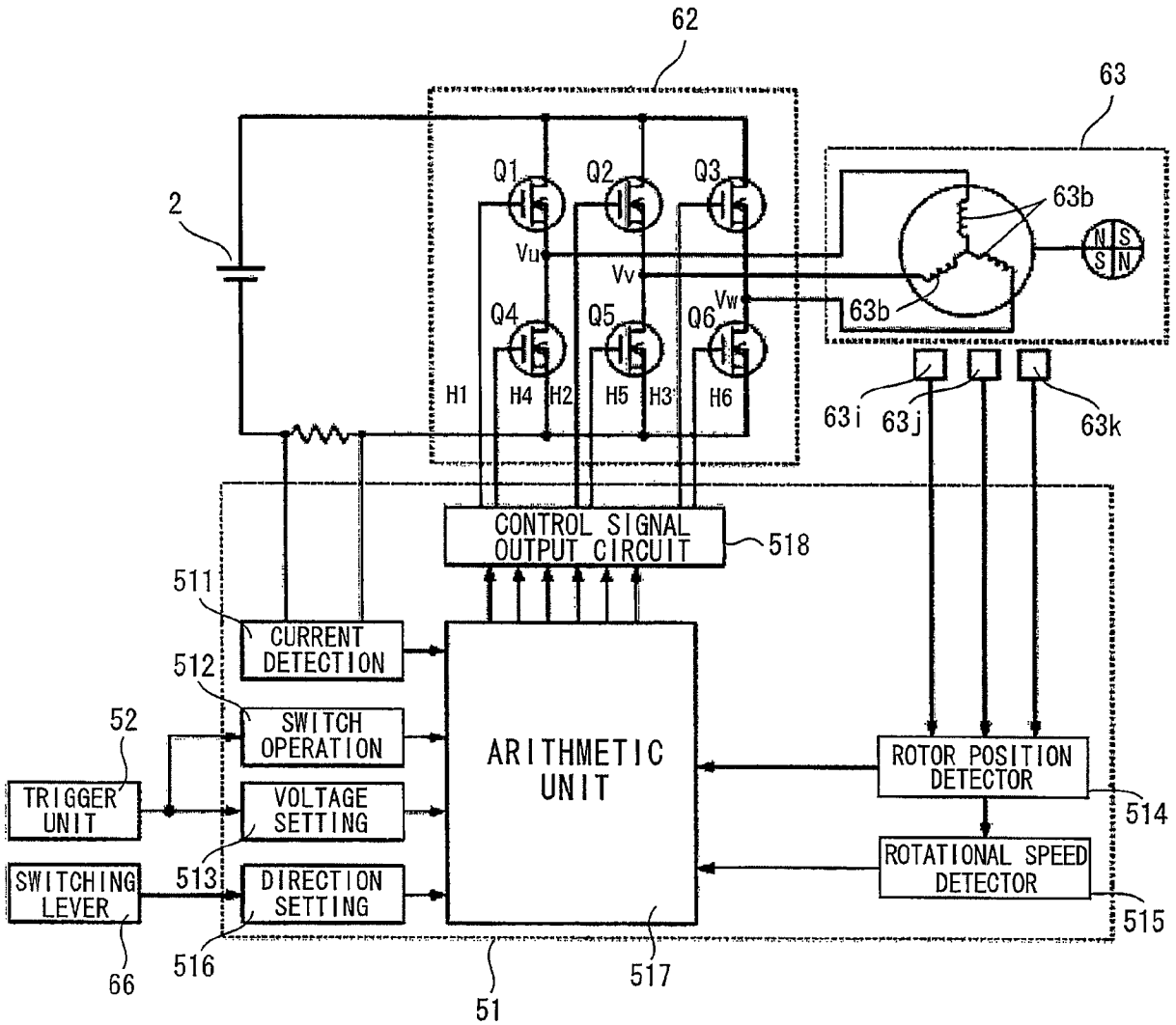
FIG. 3 is a circuit diagram illustrating a control circuit section, an inverter circuit section, and a motor.

Next, the circuitry of the control circuit section 51, inverter circuit section 62, and motor 63 mentioned above will be described with reference to FIG. 3. FIG. 3 is a diagram illustrating the circuit configurations for the control circuit section 51, inverter circuit section 62, and motor 63.

The control circuit section 51 includes a current detection circuit 511, a switch operating detection circuit 512, an applied voltage setting circuit 513, a rotor position detection circuit 514, a rotational speed detection circuit 515, a rotating direction setting circuit 516, an arithmetic unit 517, and a control signal output circuit 518.

The current detection circuit 511 detects the electric current passing through the motor 63 (stator coils 63*b*) and outputs the detected current to the arithmetic unit 517. The switch operating detection circuit 512 detects inward pressure on the trigger unit 52 and outputs the detected result to the arithmetic unit 517. The applied voltage setting circuit 513 sets the PWM duty cycle of the PWM drive signal for driving the switching elements Q1-Q6 of the inverter circuit section 62 based on the target value signal outputted from the trigger unit 52 and outputs the set duty cycle to the arithmetic unit 517.

The rotor position detection circuit 514 detects the position of the rotor 63*c* based on detection signals outputted from the Hall ICs 63*i*-63*k* and outputs the detected position to the arithmetic unit 517. The rotational speed detection circuit 515 detects the rotational speed of the motor 63 based on time intervals between detection signals for the rotated position outputted from the Hall ICs 63*i*-63*k* and outputs this rotational speed to the arithmetic unit 517. The rotating direction setting circuit 516 sets the rotating direction of the motor 63 (rotor 63*c*) according to the signal outputted from the forward/reverse switching lever 66 and outputs the corresponding signal to the arithmetic unit 517.

Figure 4:
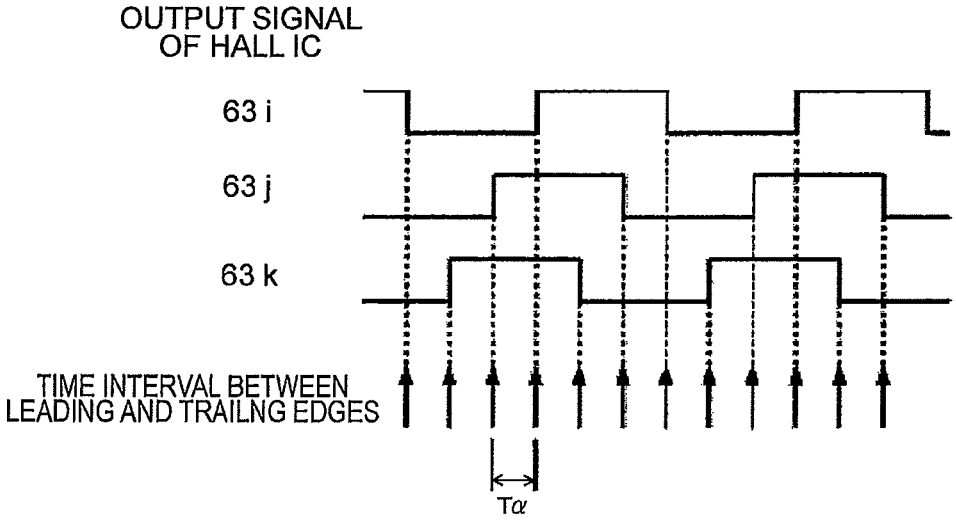
FIG. 4 shows waveforms of signals outputted from Hall ICs while the motor is rotating.
Figure 5A:
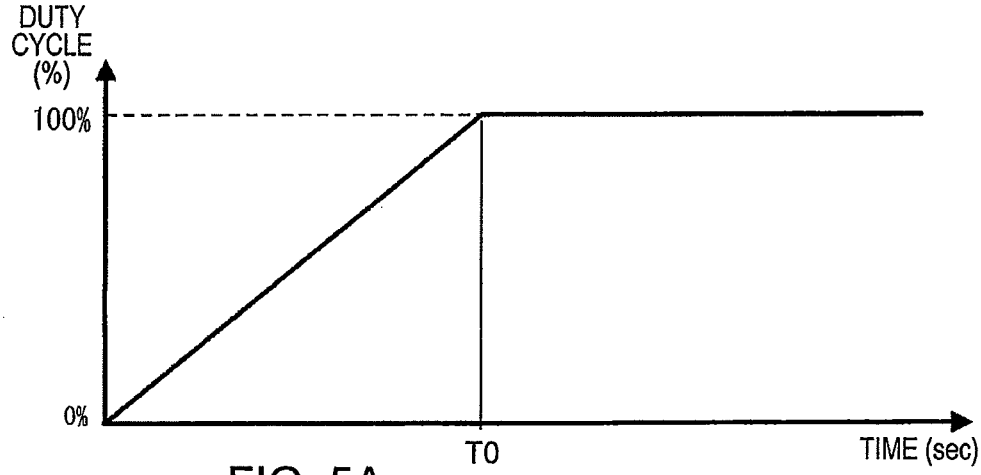
FIGS. 5A-5C are graphs illustrating a conventional soft-start control process of the drill driver.
Figure 5B:
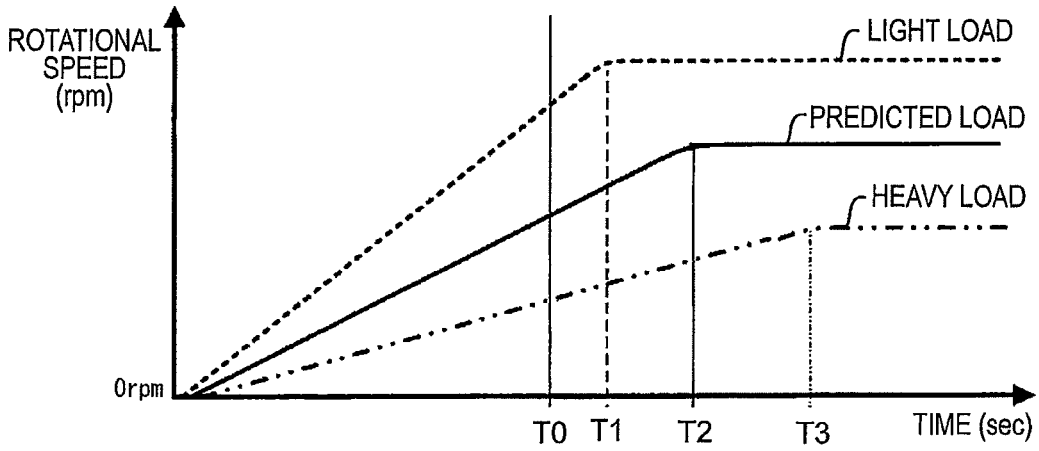
Figure 5C:
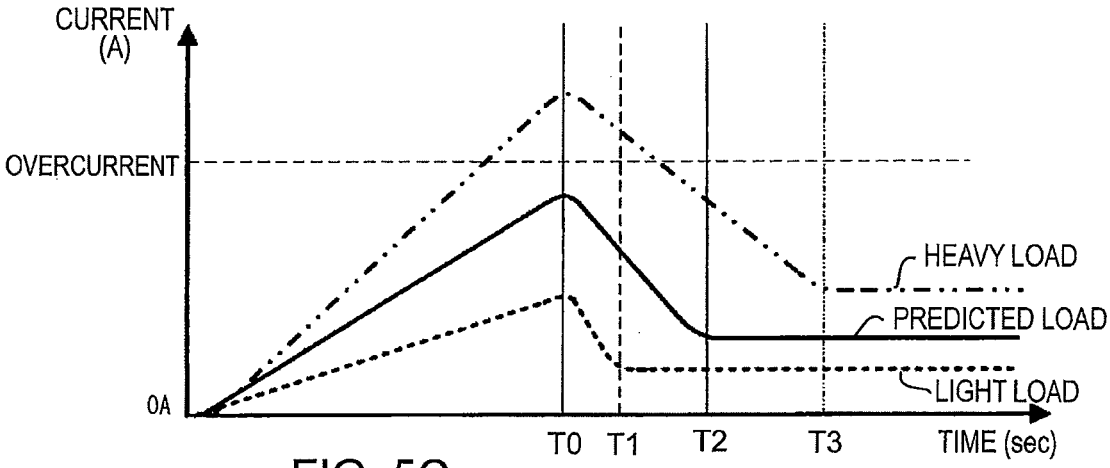
FIG. 5C PRIOR ART
Figure 6A:
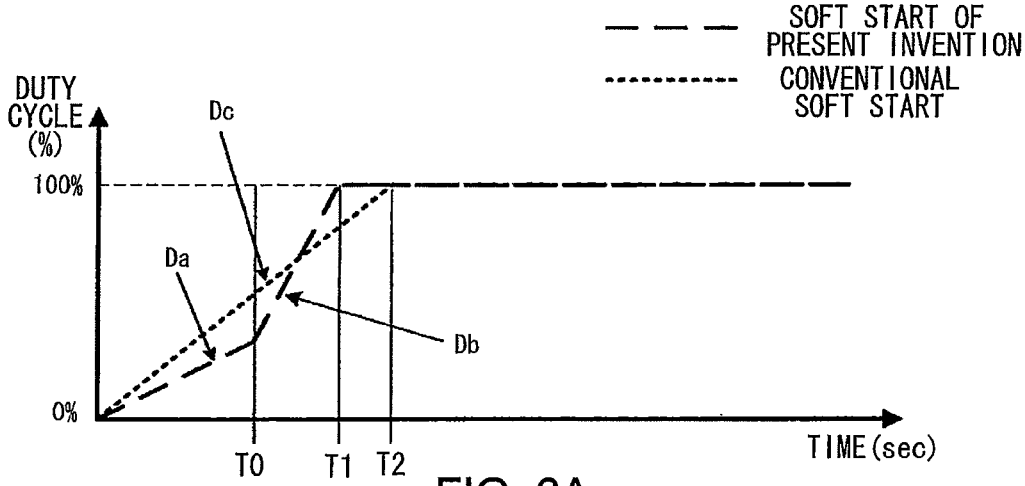
FIGS. 6A-6C are graphs illustrating a soft-start control according to the present invention, when a motor load is light.
Figure 6B:
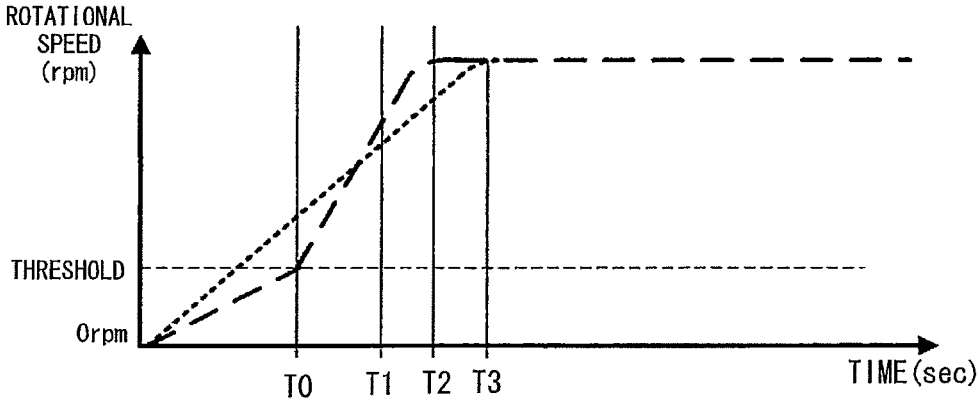
Figure 6C:
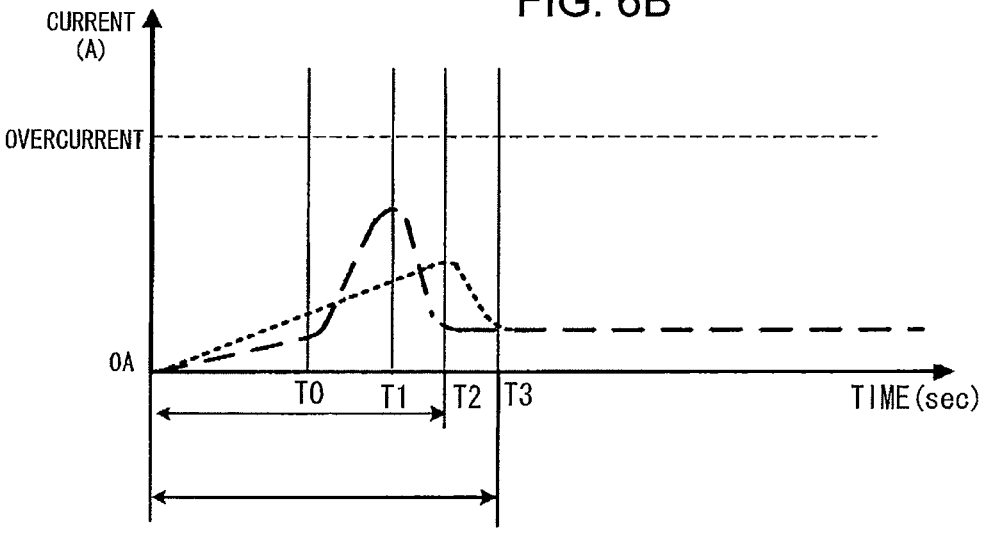
Figure 7A:
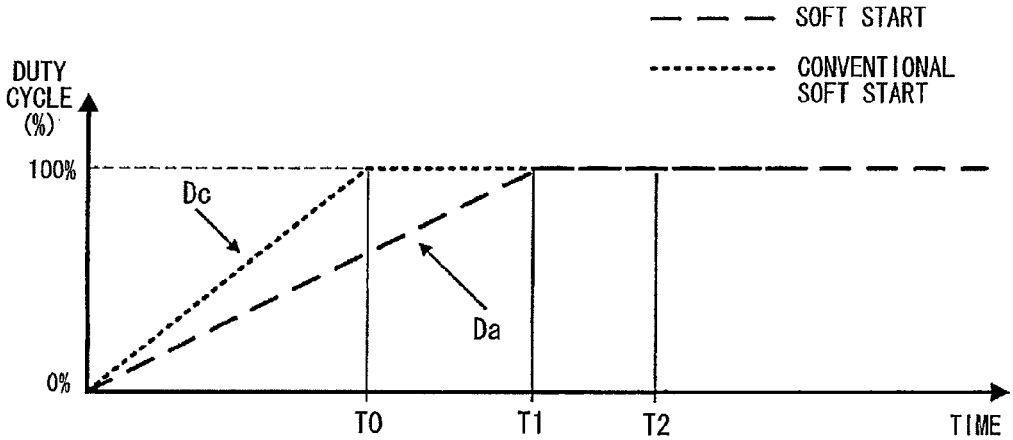
FIGS. 7A-7C are graphs illustrating a soft-start control according to the present invention, when a motor load is heavy.
Figure 7B:
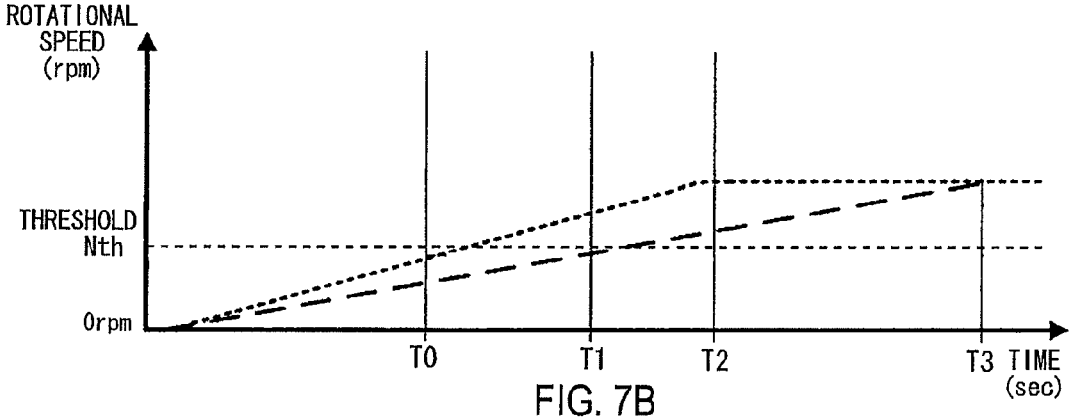
Figure 7C:
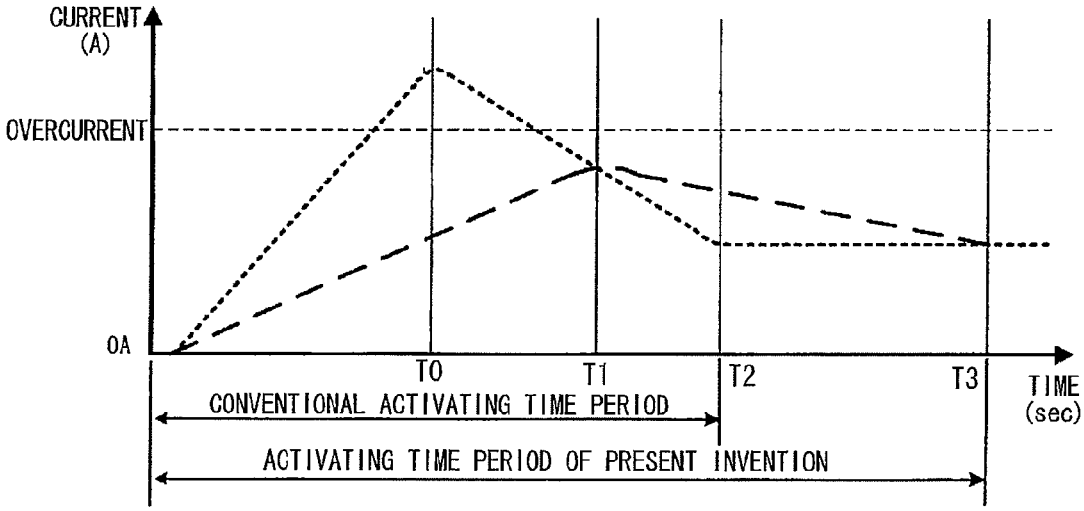

Next, the method in which the rotational speed detection circuit 515 detects the rotational speed of the motor 63 will be described with reference to FIG. 4. FIG. 4 shows one example of waveforms of signals outputted from the Hall ICs 63*i*-63*k* indicating the detected position of the motor 63 as the motor 63 is rotating.

The rotational speed detection circuit 515 detects the rotational speed of the motor 63 based on the interval between the leading edge and the subsequent trailing edge of the detection signals outputted from the Hall ICs 63*i*-63*k*.

Specifically, the detection signal for the rotated position of the motor 63 rises when the corresponding Hall IC (63*i*-63*k*) opposes one end of a permanent magnet 63*h* along the rotating direction, and falls when the Hall IC (63*i*-63*k*) opposes the other end of the same permanent magnet 63*h*. In this embodiment, the Hall ICs 63*i*-63*k* are disposed at 60 degree intervals along the rotating direction, and the permanent magnets 63*h* are arranged at 90 degree intervals, while alternating between the N-pole and S-pole. Therefore, a detection signal rises or falls every time the rotor 63*c* rotates 30 degrees. Since the time interval Ta (msec) between the leading edge and trailing edge is the time period required for the motor 63 to rotate 30 degrees, the rotational speed N (rpm) of the motor 63 can be found from the equation N (rpm)=(1000/(Ta(msec)×12))×60.

The arithmetic unit 517 generates PWM drive signals H4-H6 based on output from the switch operating detection circuit 512, applied voltage setting circuit 513, and rotational speed detection circuit 515 and generates output switching signals H1-H3 based on output from the rotor position detection circuit 514 and rotating direction setting circuit 516. More specifically, when the switch operating detection circuit 512 detects inward pressure on the trigger unit 52, the arithmetic unit 517 sets the target value for the PWM duty cycle based on output from the applied voltage setting circuit 513 and sets a rate of increase for the PWM duty cycle (described later) based on output from the rotational speed detection circuit 515.

The control signal output circuit 518 outputs the output switching signals H1-H3 and PWM drive signals H4-H6 generated by the arithmetic unit 517 to the inverter circuit section 62. Specifically, the control signal output circuit 518 outputs the PWM drive signals H4-H6 to the switching elements Q4-Q6 on the negative side and outputs the output switching signals H1-H3 to the switching elements Q1-Q3 on the positive side.

The inverter circuit section 62 outputs a voltage corresponding to the pressed amount of the trigger operating part 52*a* (target value for the PWM duty cycle) based on the PWM drive signals H4-H6 and sets the stator coils 63*b* (U, V, W) to be applied by this voltage based on the output switching signals H1-H3. Through this process, the inverter circuit section 62 sequentially applies three-phase AC voltages Vu, Vv, and Vw at 120-degree conduction angles to the three-phase stator coils 63*b* (U, V, W). Alternatively, the control signal output circuit 518 may be configured to output the PWM drive signals H4-H6 to the switching elements Q1-Q3 and the output switching signals H1-H3 to the switching elements Q4-Q6.

The arithmetic unit 517 generates a break signal to turn on the switching elements Q4-Q6 on the negative side and turn off the switching elements Q1-Q3 on the positive side for halting rotation of the motor 63. While simply turning off the switching elements Q1-Q3 on the positive side would allow the motor 63 to continue rotating by its inertia, turning on the switching elements Q4-Q6 on the negative side short-circuits the stator coils 63*b*, forming a current path. Thus, the kinetic energy of the rotating motor 63 produced by its inertia is converted to electric energy that diverges to this current pathway (short-circuit braking), applying a brake to the rotation of the motor 63 caused by inertia.

As described above, the drill driver 1 controls the rotational speed of the motor 63 at all times. However, in this embodiment, the drill driver 1 also performs soft-start control based on the size of load applied to the motor 63 when the trigger unit 52 is squeezed (when the motor 63 is started).

Next, the soft-start control according to the present invention will be described with reference to FIGS. 5 through 8.

FIGS. 5A-5C, 6A-6C, and 7A-7C show changes in the PWM duty cycle over time, changes in the rotational speed of the motor over time, and changes in current supplied to the motor over time.

Soft-start control is employed to gradually increase the PWM duty cycle to a target value in order to prevent the generation of an excessive starting current when starting the motor. Since the amount of the starting current is dependent on the voltage applied to the motor at the rotational speed of the motor, generally the starting current reaches a maximum amount when the PWM duty cycle reaches 100%. In this embodiment, it will be assumed that the target value for the PWM duty cycle is 100%, but soft-start control can be similarly performed for a different target value. Further, there are numerous methods of setting the target value for the PWM duty cycle. For example, the drill driver 1 may be configured to set the target value to 100% when the trigger unit 52 is pressed even slightly.

As shown in FIG. 5, the PWM duty cycle is increased at a fixed rate in conventional soft-start control. Consequently, the power tool takes more time than necessary for starting up the motor when the load applied to the motor (i.e., a motor load) is light and, hence, presents little risk of producing a large starting current. In addition, the power tool responds poorly to trigger operations in supplying power to the motor. A power tool of this type appears to have very poor handling and operating capabilities, particularly when the user is tightening a small screw through repeated on/off trigger operations. On the other hand, when the load is greater than predicted, this conventional power tool will generate a large starting current (overcurrent), even when performing soft-start control. The excessive current increases the temperature of the components, potentially leading to burnout of the motor, inverter circuit, and the like.

In the present invention, a heavy motor load means that the rotational speed of the motor is relatively slow due to a heavy load electrically connected to the motor 63 though the current flow passing through the motor 63 is relatively large. On the other hand, a light motor load means that the rotational speed of the motor is relatively high due to a light load electrically connected to the motor 63 though the current flow passing through the motor 63 is relatively small. Accordingly, detection of the rotational speed of the motor leads to determination as to whether the motor load is heavy or light.

Therefore, in soft-start control according to the present invention, the drill driver 1 changes the rate of increase in the PWM duty cycle based on the size of the motor load. As shown in FIG. 6, the drill driver 1 begins soft-start control using an increase rate Da for the PWM duty cycle. If the rotational speed of the motor 63 passes a threshold $N_{th}$ prior to the PWM duty cycle reaching 100%, the drill driver 1 determines that the load is light and adjusts the rate of increase to a larger rate Db than the rate Da. Assuming that the conventional increase rate Dc is 0.5%/msec, in this embodiment the increase rate Da is set to 0.3%/msec, the increase rate Db is set to 1.2%/msec, and the threshold $N_{th}$ is set to 4000 rpm. This configuration allows the drill driver 1 to shorten the starting time period required for increasing the PWM duty cycle to the target value. In addition, since the drill driver 1 accelerates the motor 63 from its rest state to high-speed rotations within a shorter time period, even when fastening a small screw through repeated on/off operations of the trigger unit 52, this configuration greatly improves the ability of the drill driver 1 to respond to operation of the trigger unit 52 for supplying power to the motor 63.

On the other hand, if the rotational speed of the motor 63 does not exceed the threshold $N_{th}$ until the PWM duty cycle reaches 100%, the drill driver 1 determines that the load is heavy and does not change the rate of increase, thereby preventing the generation of a large starting current caused by applying a large voltage to the motor 63 while the motor 63 is rotating at a slow speed. Since the rate Da is set smaller than the increase rate Dc in the conventional soft-start control process, the drill driver 1 completes soft-start control without generating a starting current large to enter the overcurrent region, as shown in FIG. 7. In this way, the above control process prevents burnout in the motor, inverter circuit, or the like caused by an increase in temperature, thereby improving the products reliability.

Next, the operations of the control circuit section 51 during soft-start control will be described with reference to the flowchart in FIG. 8. The control circuit section 51 begins this process when the power supply to the drill driver 1 is turned on.

Figure 8:
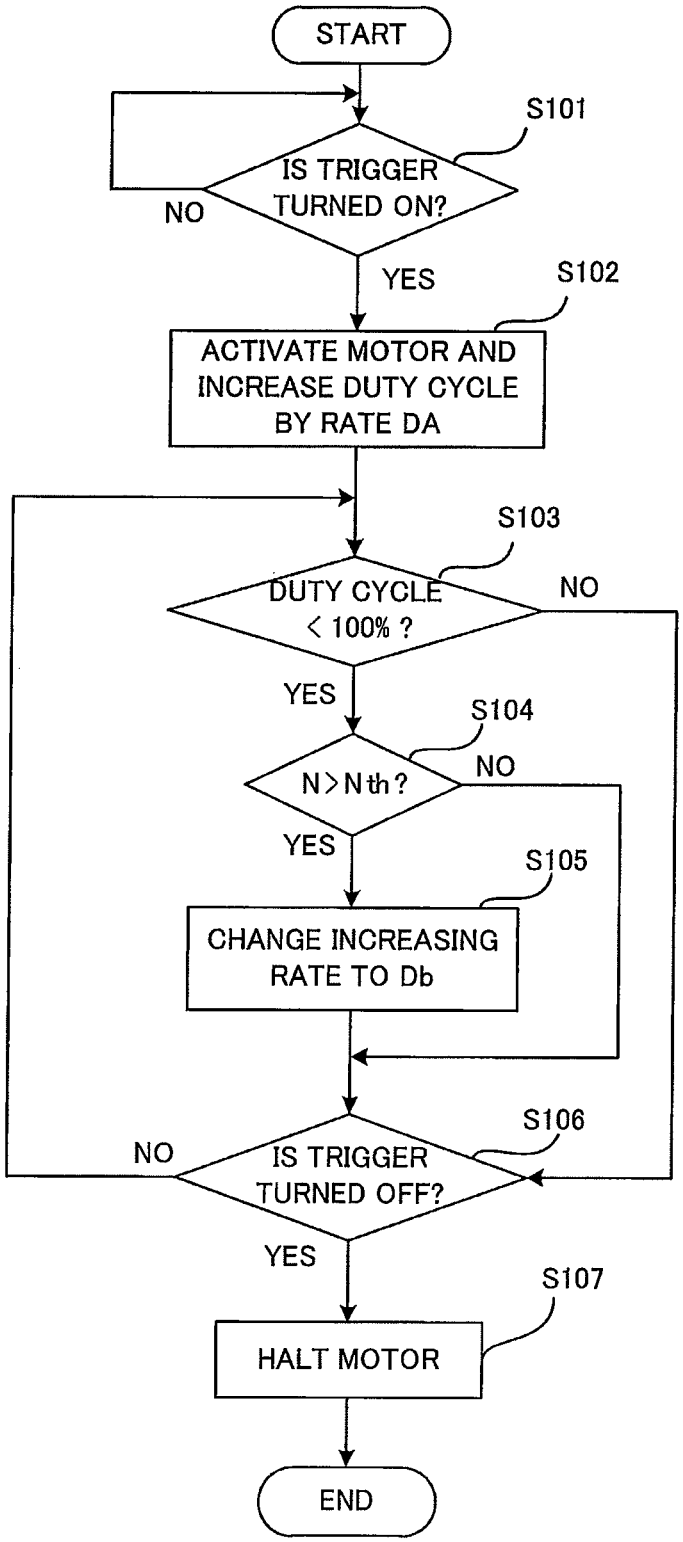
FIG. 8 is a flow chart illustrating operations of the control circuit section during the soft-start control according to the present invention.

In S101 at the beginning of the process in FIG. 8, the control circuit section 51 determines whether the trigger unit 52 has been switched on. If the trigger unit 52 is turned on (S101: YES), in S102 the control circuit section 51 actuates the motor 63 and increases the PWM duty cycle at the rate Da. Subsequently, in S103, the control circuit section 51 determines whether the duty cycle is less than 100%. If the duty cycle is less than 100% (S103: YES), the control circuit section 51 goes to S104 and determines whether the rotational speed N of the motor 63 is greater than the threshold $N_{th}$. If the rotational speed N is greater than the threshold $N_{th}$ (S104: YES), in S105 the control circuit section 51 changes the rate of increase of the PWM duty cycle to the rate Db. In S106 the control circuit section 51 determines whether the trigger unit 52 has been switched off.

On the other hand, if the duty cycle is 100% (S103: NO), the control circuit section 51 skips to S106 and determines whether the trigger unit 52 has been switched off. And if the control circuit section 51 determines that the rotational speed N has not exceeded the threshold $N_{th}$ within a predetermined time period (S104: NO), then the control circuit section 51 skips to S106 and determines whether the trigger unit 52 has been switched off. If the trigger unit 52 has not been switched off (S106: NO), the control circuit section 51 returns to S103 and again determines whether the duty cycle is less than 100%. However, if the trigger unit 52 has been switched off (S106: YES), in S107 the control circuit section 51 halts rotation of the motor 63.

As described above, the drill driver 1 modifies the rate of increase in the duty cycle of the voltage applied to the motor when starting up the motor based on the rotational speed of the motor 63 (the magnitude of load applied to the motor 63). Accordingly, the drill driver 1 can perform soft-start control suitable for the magnitude of load.

Next, the method of setting the threshold $N_{th}$ and the increase rates Da and Db will be described. In this embodiment, the threshold $N_{th}$ and the increasing rate Da are set by performing an operation for the heaviest predictable load, while the rate Db is set by performing an operation for the lightest predictable load. Specifically, the rate Da is set to a value that prevents the starting current from entering the overcurrent region when performing an operation at the heaviest load. The threshold $N_{th}$ is set to a value larger than the rotational speed of the motor at the moment the PWM duty cycle has reached 100%, provided that the rate Da at which the PWM duty cycle is increased does not change. And The threshold $N_{th}$ is set to be smaller than a normal rotational speed of the motor in a steady condition. The rate Db is set to a value that prevents the starting current from entering the overcurrent region, when the rotational speed of the motor reaches the threshold $N_{th}$ and the rate of increase in the duty cycle of the applied voltage is switched from the rate Da.

While a power tool according to the invention has been described in detail with reference to specific embodiments thereof, it would be apparent to those skilled in the art that many modifications and variations may be made therein without departing from the spirit of the invention, the scope of which is defined by the attached claims.

For example, while a single threshold $N_{th}$ is set in the above embodiment, two or more threshold values may be set so that the rate of increase in the PWM duty cycle is changed in a plurality of steps. Further, the drill driver 1 may determine that the load is heavier than predicted and may reduce the rate of increase in the voltage applied to the motor when the rotational speed of the motor 63 does not rise to a prescribed value after a prescribed time has elapsed during soft-start control. This method can further improve reliability of the product.

In the embodiment described above, the drill driver 1 determines load based on the rotational speed of the motor, but load may be determined using the value detected by the current detection circuit 511 for electric current flowing in the motor 63.

In the embodiment described above, the drill driver 1 serves as an example of the power tool according to the present invention, but the present invention may be applied to another power tool, such as an impact driver or hammer drill.

In the embodiment described above, the motor is described as the brushless DC motor 63, whose rotational speed is controlled through pulse width modulation. However, the present invention may be applied to a universal motor whose TRIAC conduction angle is phase-controlled using thyristors.

In this embodiment described above, the control unit of the present invention uses pulse width modulation (PWM) for control, but pulse amplitude modulation (PAM) or the like may be used instead.

What is claimed is:

1. A power tool comprising:

a motor;

a power supply unit that supplies power to the motor;

a trigger unit that causes the power supply unit to start applying a voltage to the motor;

a control unit that controls the power supply unit to increase the voltage to the motor at a constant increasing rate; and a motor load detection unit that detects a motor load, wherein the control unit changes the constant increasing rate in accordance with the motor load, wherein the control unit comprises a determination unit that determines whether the motor load is heavy or light, wherein the control unit increases the constant increasing rate if the determination unit determines that the motor load is light.

2. The power tool as claimed in claim 1, wherein the power supply unit comprises a switching unit that is controlled by Pulse Width Modulation (PWM) to supply power to the motor.

3. The power tool as claimed in claim 1, wherein the power supply unit comprises a switching unit that is controlled by Thyristor Phase control to supply power to the motor.

4. The power tool as claimed in claim 1, wherein the voltage applied to the motor is an effective value.

5. A power tool comprising:

a motor;

a power supply unit that supplies power to the motor;

a trigger unit that causes the power supply unit to start applying a voltage to the motor;

a control unit that controls the power supply unit to increase the voltage to the motor at a constant increasing rate; and a motor load detection unit that detects a motor load, wherein the control unit changes the constant increasing rate in accordance with the motor load;

a detection unit that detects a rotational speed of the motor; and a determination unit that determines whether the rotational speed of the motor exceeds a threshold within a first time period after a beginning of power supply to the motor, wherein the control unit increases the constant increasing rate if the determination unit determines that the rotational speed of the motor exceeds the threshold.

6. The power tool as claimed in claim 5, wherein the control unit has a plurality of thresholds, the control unit increases the constant increasing rate every time the detected rotational speed exceeds the plurality of thresholds in ascending order.

7. The power tool as claimed in claim 5, wherein the threshold is used to determine whether the motor load is heavy or light, if the rotational speed exceeds the threshold within the first time period, the control unit determines that the motor load is light, if the rotational speed does not exceed the threshold within the first time period, the control unit determines that that the motor load is heavy.

8. The power tool as claimed in claim 5, wherein the power supply unit comprises a switching unit that is controlled by Pulse Width Modulation (PWM) to supply power to the motor.

9. The power tool as claimed in claim 5, wherein the power supply unit comprises a switching unit that is controlled by Thyristor Phase control to supply power to the motor.

10. The power tool as claimed in claim 5, wherein the voltage applied to the motor is an effective value.

11. A power tool comprising:

a motor;

a power supply unit that supplies power to the motor;

a trigger unit that causes the power supply unit to start applying a voltage to the motor;

a control unit that controls the power supply unit to increase the voltage to the motor at a constant increasing rate; and a motor load detection unit that detects a motor load, wherein the control unit changes the constant increasing rate in accordance with the motor load, wherein the motor load detection unit detects a rotational speed of the motor within a first time period from a beginning of power supply to the motor, and the control unit determines whether the motor load is heavy or light in accordance with the detected motor load, and wherein if the detected rotational speed exceeds a threshold within the first time period, the control unit determines that the motor load is light and then increases the constant increasing rate, and if the detected rotational speed does not exceed the threshold, the control unit determines that the motor load is heavy and then maintain the constant increasing rate.

12. The power tool as claimed in claim 11, wherein the power supply unit comprises a switching unit that is controlled by Pulse Width Modulation (PWM) to supply power to the motor.

13. The power tool as claimed in claim 11, wherein the power supply unit comprises a switching unit that is controlled by Thyristor Phase control to supply power to the motor.

14. The power tool as claimed in claim 11, wherein the voltage applied to the motor is an effective value.

* * * * *